US005850749A

United States Patent [19]

Kim

[11] Patent Number: 5,850,749

[45] Date of Patent: Dec. 22, 1998

[54] BALANCING DEVICE FOR A DRUM WASHING MACHINE

[75] Inventor: Jin-Soo Kim, Suwon, Rep. of Korea

[73] Assignee: Samsung Electronics Co., Ltd., Suwon, Rep. of Korea

[21] Appl. No.: 865,680

[22] Filed: May 30, 1997

[30] Foreign Application Priority Data

May 30, 1996 [KR] Rep. of Korea ..... 96-13845
May 30, 1996 [KR] Rep. of Korea ..... 96-13855

[51] Int. Cl.[6] ..... D06F 37/22

[52] U.S. Cl. ..... 68/23.2; 74/573 R; 74/573 F

[58] Field of Search ..... 68/23.2; 210/144, 210/363, 364; 74/573 F, 573 R

[56] References Cited

U.S. PATENT DOCUMENTS 2,984,094 5/1961 Belaieff ..... 68/23.2
3,696,688 10/1972 Goodrich et al. ..... 74/273 R
5,460,017 10/1995 Taylor ..... 68/23.2

FOREIGN PATENT DOCUMENTS 1 213 067 3/1960 France .
2 393 097 12/1978 France .
1 912 481 3/1965 Germany .

*Primary Examiner*—Philip R. Coe
*Attorney, Agent, or Firm*—Burns, Doane, Swecker & Mathis, L.L.P.

[57] ABSTRACT

A drum washing machine includes a tub suspended in a housing; a drum-type spin basket rotatably installed in the tub, and at least two radially spaced races provided on the spin basket concentric with the spin basket. Each race containing liquid and a plurality of balancer balls. The radially inner race has internal surfaces that are smoother than those of the radially outer race. The liquid in the inner race has less viscosity than the liquid in the outer race. The balls in the inner race have a smaller diameter than the balls in the outer race.

3 Claims, 3 Drawing Sheets

BALANCING DEVICE FOR A DRUM WASHING MACHINE

BACKGROUND OF THE INVENTION (1) Field of the Invention

The present invention generally relates to a balancing device for a drum washing machine. More particularly, it relates to a balancing device for a drum washing machine realized as annular-shaped races provided to the drum washing machine's spin basket, which contain movable balls and a viscous liquid to assist the smooth movement of the balls.

(2) Description of the Prior Art

A conventional drum washing machine is an electronic appliance in which clothes are washed by the suds generated by the rotation of its drum-type spin basket. With the conventional drum washing machine, washing, rinsing and hydro-extracting tasks are automatically carried out according to a specific program. After the washing and rinsing steps, excess water is removed from the garment by centrifugal force created by the spin basket rotating at high speeds during the hydro-extracting step. Abnormal vibrations and noise may be produced by the uneven distribution of clothes in the spin basket during this step, so a balancing device is essential for the smooth operation of the appliance.

FIG. 3 is a perspective view of the overall construction of a conventional drum washing machine.

Referring to FIG. 3, the drum washing machine includes a housing 1, a tub 2 suspended by suspension springs 4*a* and shock-absorbing members 4*b* in the housing 1, and a spin basket 3 rotatably installed in the tub 2. The spin basket 3, which is rotated by an electric motor 5 installed on the bottom of the housing 1, includes a plurality of small holes 3*a* uniformly formed on its cylindrical surface, and a plurality of lifters 3*b* protruding inward. Water that is removed from clothes in the spin basket 3 by centrifugal force drains into the tub 2 through the small holes 3*a*, and the lifters 3*b* enhance the creation of suds as the spin basket 3 rotates.

In order to prevent the generation of vibrations during the washing/hydro-extracting process, counterweights, each of predetermined weight, are attached to the tub 2. An 11.4 kg front counterweight 6*a* is provided to the front of the tub 2, and a 12.2 kg upper counterweight 6*b* is mounted on the top surface of the tub 2. The counterweights 6*a* and 6*b* are made from cast iron and are joined to the tub 2 by bolts 7.

Rather than preventing the creation of vibrations by laundry unevenly distributed in the washing machine, such a conventional balancing device simply restrains the vibrations, and thus has inferior balancing characteristics.

Furthermore, the conventional balancing device does not restrain the unbalance in the initial stage because it reduces the vibrations after they have been already transmitted to the tub. This causes noise and damage to the washing machine's components.

SUMMARY OF THE INVENTION

The present invention concerns a balancing device for a drum washing machine that can obviate the above-described problems and disadvantages of the conventional art.

It is an objective of the present invention to provide a drum washing machine balancing device that dynamically counteracts an imbalance, created by the uneven distribution of laundry in the washing machine's spin basket during rotation, in the initial stage of the vibration.

It is another objective of the present invention to provide a drum washing machine balancing device of which the diameter of each of balls, the viscosity of a liquid, and the roughness of each race are properly regulated so as to dynamically counteract unbalances created during the rotation of the spin basket and to have more effective balancing characteristics during operation.

In order to obtain the aforementioned objectives, there is disclosed a balancing device for a drum washing machine that includes a tub suspended in the drum washing machine's housing; a drum-type spin basket rotatably installed in the tub; and at least two races provided to the spin basket concentrical with the spin basket that contain a viscous liquid and a plurality of balls. A high level of smoothing of 1.5 S to 6 S is carried out on the inner walls of the race positioned inside the spin basket, the viscous liquid held in the race is 100±20 cst in viscosity, and the diameter of the ball in the inner race is 12.7±0.5 mm, while a normal smoothing of 12 S is performed on the inner walls of the race positioned outside the spin basket, the liquid held in the race is 160±20 cst in viscosity, and the diameter of the ball in the outer race is 15.875±0.5 mm.

According to another embodiment of the present invention, the balancing device is constructed as above, with the exception of the roughness of both races' inner walls is 10±0.5 S.

DETAILED DESCRIPTION OF THE PREFERRED EMBODIMENT

The preferred embodiment of the present invention will now be described in detail with reference to the accompanying drawings.

Figure 1:
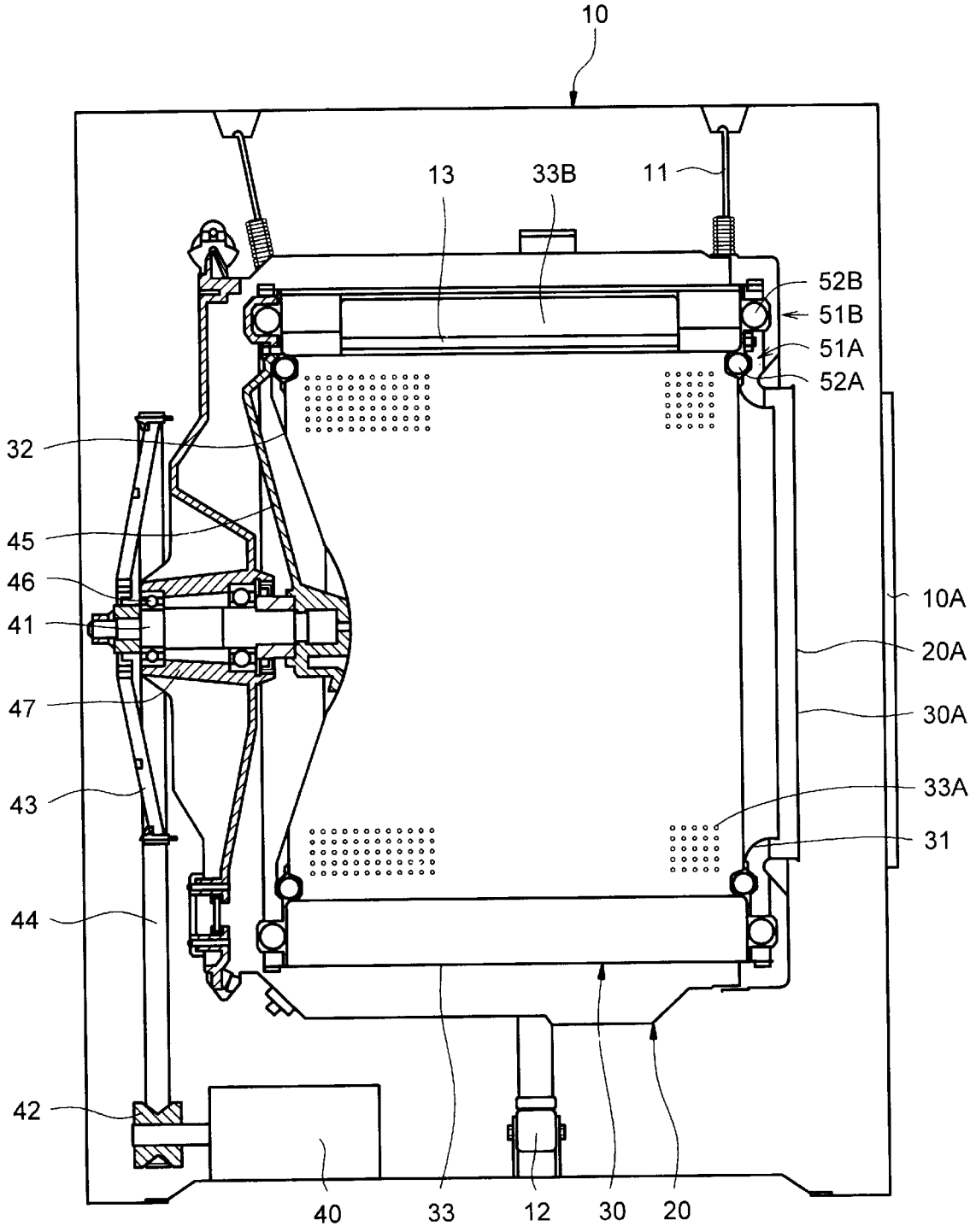
FIG. 1 is a sectional view of a drum washing machine with a balancing device in accordance with the present invention.

FIG. 1 is a sectional view showing the overall construction of a drum washing machine equipped with a balancing device in accordance with the present invention.

As shown in FIG. 1, the drum washing machine includes a housing 10, a tub 20 suspended in the housing 10, a spin basket 30 rotatably installed within the tub 20, and an electric motor 40 mounted below the tub 20 that rotates the spin basket 30. The tub 20 is suspended by four springs 11 connected to opposite sides of the housing 10, and a pair of shock absorbing members 12 are provided under the tub 20.

The tub 20 and spin basket 30 are installed parallel to the ground rather than upright, and openings 10*a*, 20*a* and 30*a* are respectively formed: on the front of the housing 10, on a predetermined spot of the tub 20 corresponding to the front of the housing 10, and on a corresponding spot of the spin basket 30 so that laundry can be put into or taken out of the spin basket 30 therethrough.

The spin basket 30 consists of a cylindrically-shaped side panel 33, and front and rear panels 31 and 32 respectively joined to the front and back of the side panel 33. Three inward protruding lifters 33*b*, spaced 120° from each other, are formed on the side panel 33 in the form of a "V" for the purpose of raising and dropping the laundry during washing. A plurality of holes 33*a* are uniformly formed in the side panel 33, which allow water to flow freely between the tub 20 and the spin basket 30, and provide a path through which water removed from laundry during the hydro-extracting process can drain into the tub 20.

The rotating force of the electric motor 40 is transmitted to the spin basket 30 through the rear panel 32 by way of a shaft 41 connected thereto. The shaft 41, horizontally supported, extends from the rear panel 32 to the rear of the tub 20. A first pulley 42 is connected to the electric motor 40, and a second pulley 43 is connected to the shaft 41. A belt 44 is placed between the first and second pulleys 42 and 43, and a flange 45 is provided to the rear panel 32 connected with the shaft 41. A pair of bearings 46, positioned in a bearing housing 47, are installed between the shaft 41 and the tub 20 so as to support the shaft 41.

The spin basket 30 has a pair of balancing devices each provided to the front and rear panels 31 and 32 to remove the vibrations and imbalances created during its rotation. The balancing devices are realized as annular radially inner and outer races 51*a* and 51*b* that are concentrically formed on inner and outer parts of the front and rear panels 31 and 32, and a plurality of balls 52*a* and 52*b* that are seated in the races 51*a* and 51*b*. As described above, the races 51*a* and 51*b* are placed on inner and outer parts of the front and rear panels 31 and 32, and the inner race 51*a* and the outer race 51*b* protrude inward and outward, respectively. The inner race 51*a* and the outer race 51*b* are formed by welding, which also makes them hermetically sealed. The races 51*a* and 51*b* contain a predetermined amount of liquid to allow the balls 52*a* and 52*b* to move freely.

The balancing device of the present invention will be more fully described as follows. Because the races 51*a* and 51*b*, provided to the front panel 31 and rear panel 32, are formed symmetrically, only the structure of the races 51*a* and 51*b* on the front panel 31 will be described.

Figure 2:
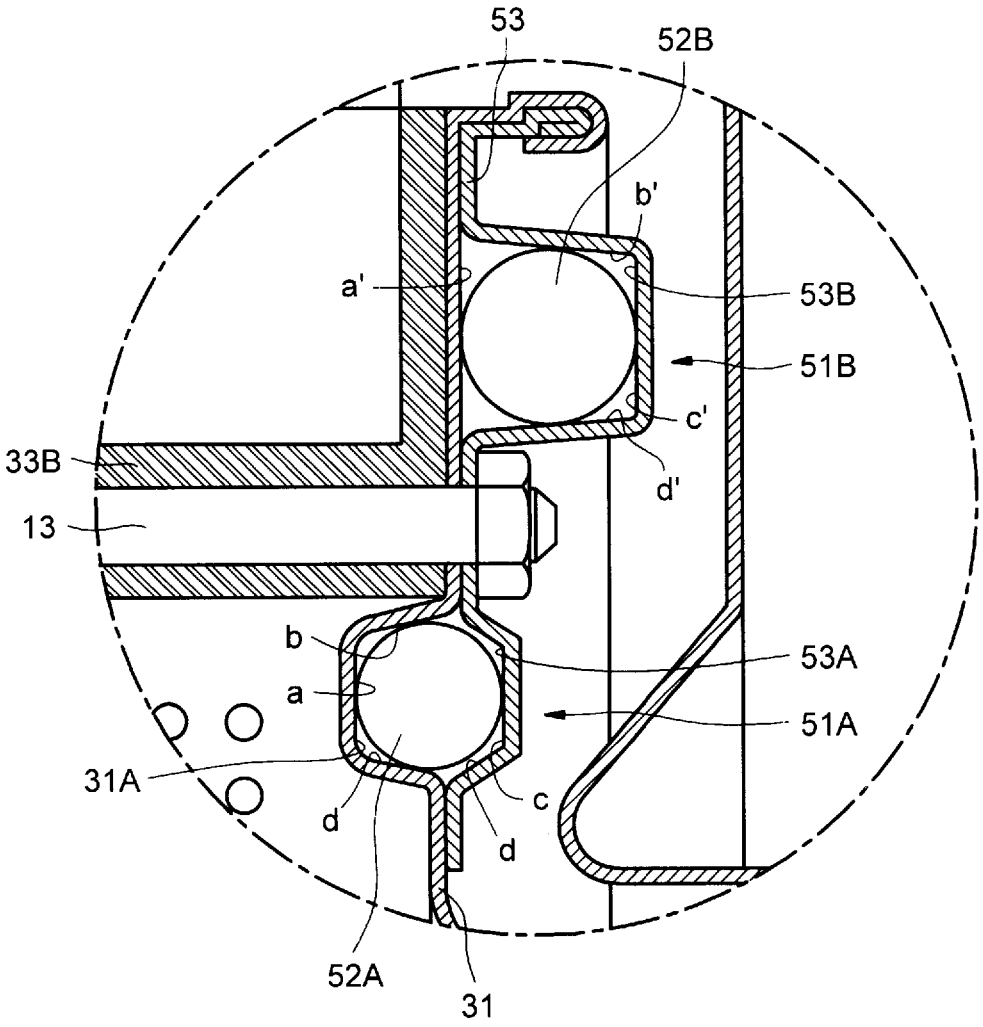
FIG. 2 is an enlarged view of a part of the balancing device of FIG. 1.
Figure 3:
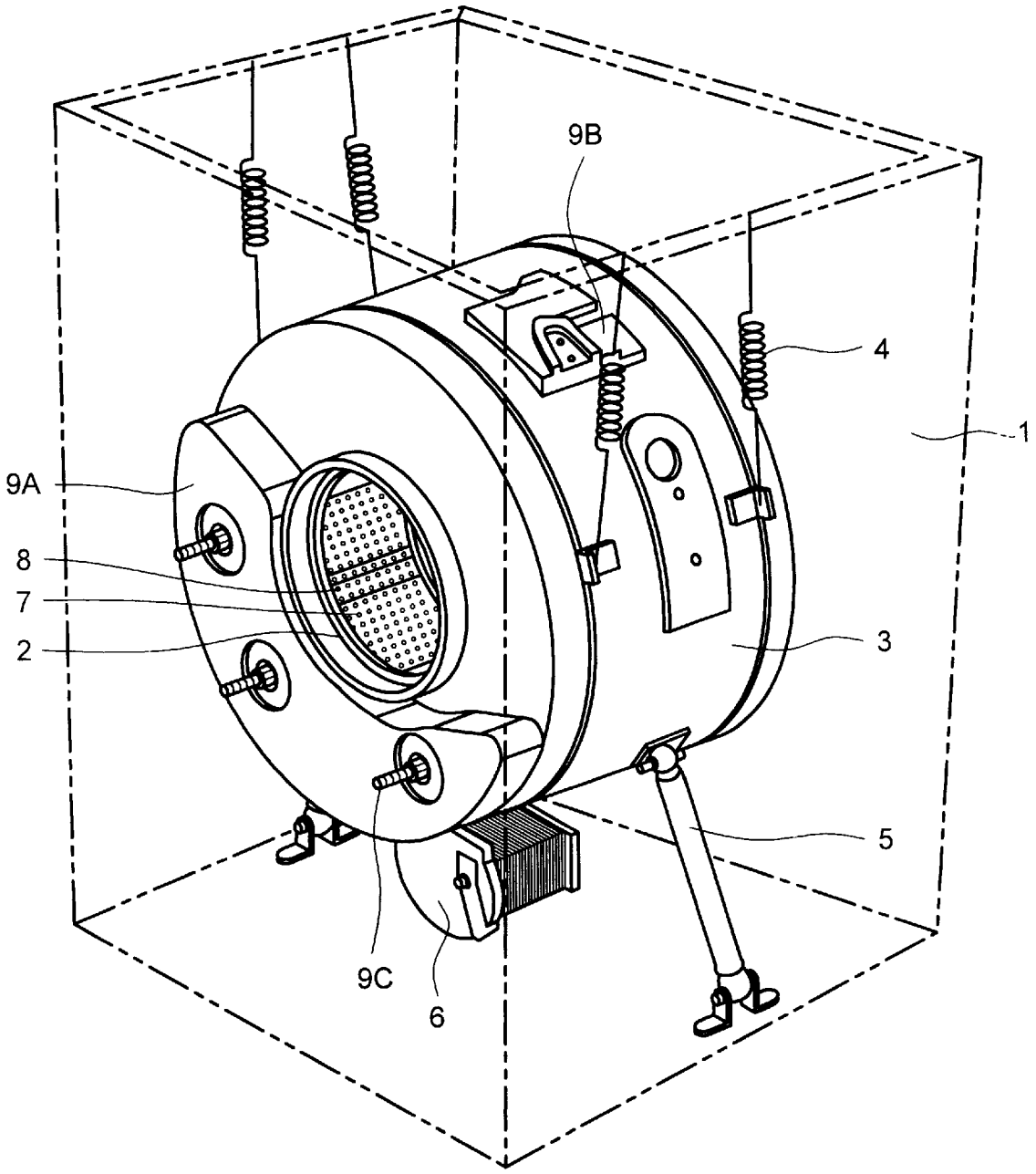
FIG. 3 (PRIOR ART)
FIG. 3 is a perspective view of the overall construction of a conventional drum washing machine.

As shown in FIG. 2, the races 51*a* and 51*b* are shaped by the front panel 31 and a cover 53 joined to the front panel 31. The outer race 51*b* is formed by the combination of the flat portion of the front panel 31 and a groove 53*b* created in the cover 53. The inner race 51*a* is formed by the combination of a first groove 31*a* of the front panel 31 and a second groove 53*a* of the cover 53. Finally, the cover 53, the front panel 31, and the rear panel 32 are all fastened together by a bolt 13. Each of the races 51*a* and 51*b* is supplied with liquid through a hole 53*c* formed thereon.

The races 51*a* and 51*b* each have four inner walls a, b, c and d, and a', b', c' and d', respectively, thus forming an annular-shaped space. The balls 52*a* and 52*b* freely move in their races 51*a* ,51*b*, and are in contact with the inner walls a, b, c and d and a', b', c' and d', respectively. If the inner walls a, b, c and d and a', b', c' and d' are too rough, much friction and abrasion are created, thereby hindering the races' ability to reduce vibrations created by the spin basket 30's normal rotation. That is, if the inner walls a, b, c and d and a', b', c' and d' are very rough, high ridges are formed on the respective inner walls, and the distance between two adjacent ridges is large, thus creating large resistance during the movement of the balls 52*a* and 52*b*, and abrading the balls 52*a* and 52*b* too much.

Since the contact surface of each of the balls 52*a*, 52*b* and the inner walls a, b, c and d and a', b', c' and d' becomes small because of the high and large ridges, the balls 52*a* and 52*b* are supported unstably to thereby cause abnormal vibration. It is preferable that the inner walls a, b, c and d, and a', b', c' and d' of the races 51*a* and 51*b* are manufactured through a normal smoothing procedure(KS B 0161 regulation: ▽▽; maximum height $R_{max}$ equals 10 S±0.5 S). Preferably, the smoothing is performed on all the inner walls a, b, c and d and a', b', c' and d', but it may be carried out just on the inner walls b and b', which the balls 52*a* and 52*b* come in close contact with, in order to reduce the cost required for the smoothing process.

The smooth movement of the balls 52*a* and 52*b* depends on the roughness of each of the races 51*a* and 51*b*, the diameter of the respective balls 52*a* and 52*b*, and the viscosity of the liquid. If the roughness of each race or the viscosity of the liquid is too great, the initial movement and rolling of the balls 52*a* and 52*b* may be hindered. Consequently, the balancing devices would not be able to dynamically and promptly compensate for abnormal vibrations created by garments unevenly arranged in the spin basket. On the contrary, if the roughness of each race or the viscosity of the liquid is too small, the vibration caused by the movement of the balls 52*a* and 52*b* may obstruct the normal operation of the spin basket 30. Therefore, the roughness of the inner walls of the races 51*a* and 51*b* and the viscosity of the liquid held in the races 51*a* and 51*b* must be properly regulated according to the diameter of the respective balls 52*a* and 52*b* in order to enhance the device's balancing characteristics. It is preferable that the balancing devices of the present invention offer superior balancing effects during the initial operation of the spin basket by making the diameter of the balls 52*a*, the viscosity of the liquid held in the race 51*a*, and the roughness of the race 51*a* different from those of the race 51*b*.

This will now be fully described with reference to the following table.

| Race | Diameter (mm) of Balls | Roughness (S) of Race | Viscosity (cst) of Liq. |
|---|---|---|---|
| Outer race | 15.785 ± 0.5 | Normal smoothing (12) | 160 ± 20 |
| Inner race | 12.7 ± 0.5 | High level of smoothing (1.5~6) | 100 ± 20 |

As shown in the above table, the diameter of the balls 52*b* held in the outer race 51*b* is 15.785±0.5 mm, and each of the inner walls a', b', c' and d' of the outer race 51*b* has a roughness of 12 S through the normal smoothing process, and the viscosity of the liquid held in the outer race 51*b* is 160±20 cst. The ball 52*a* seated in the inner race 51*a* has a diameter of 12.7±0.5 mm, and each of the inner walls a, b, c and d of the inner race 51*a* has a roughness of 1.5 S~6 S through the high-level smoothing process, and the viscosity of the liquid is 100±20 cst. Since the balls 52*b* in the outer race 51*b* are larger than the balls 52*a* of the inner race 51*a*, the inner walls a, b, c and d of a outer race 51*b* may be formed by normal smoothing, and the liquid to be contained in the outer race 51*b* is large in viscosity. The inner walls a, b, c and d of the inner race 51*a* may be formed with a high level of smoothing, and the viscosity of the liquid for the inner race 51*a* is small (100±20 cst).

The balls 52*a* that are seated in the inner races 51*a* have an initial driving force that is larger than that of the balls 52*b* in the outer race 51*b* during the rotation of the spin basket 30, so the balls 52*a* and 52*b* come to move along the inner race 51*a* and the outer race 51*b* at different speeds toward a side of the spin basket which is opposite the side of the imbalance, thus counteracting the imbalance promptly.

The following description concerns the operation of the balancing device manufactured according to the above method.

Garments to be washed are positioned on the bottom of the spin basket 30. As the spin basket 30 is rotated at high speeds by the electric motor 40 when the garments are not evenly arranged therein, the balls 52*a* and 52*b* move along the races 51*a* and 51*b* toward the opposite side of the imbalance by centrifugal force generated by the high-speed rotation of the spin basket 30, thereby compensating for the imbalance and preventing the vibration and eccentric rotation of the spin basket 30.

In other words, the spin basket 30 turns eccentric from its geometric center due to the uneven distribution of laundry within the spin basket 30. The centrifugal force from the geometric center and that of its center of rotation simultaneously act on the balls 52*a* and 52*b* in the races 51*a* and 51*b*, so that the balls 52*a* and 52*b* are repositioned to oppose the imbalance. The balls 52*a* and 52*b* turn about the geometric center of the spin basket 30, thus making the center of rotation of the spin basket 30 meet the geometric center. In this manner, the unbalanced state of the spin basket 30 is dynamically countered to eliminate the resultant vibrations and noise.

The following description relates to the movement of the balls 52*a* and 52*b*.

While the spin basket 30 is rotating, the balls 52*a* and 52*b* respectively seated in the inner and outer races 51*a* and 51*b* move to the opposite side of the imbalance created by the uneven arrangement of the laundry at different speeds, thereby dynamically compensating for the imbalance. That is, the balls 52*a* in the inner races 51*a* move faster than the balls 52*b* in the outer races 51*b* because of the high level of smoothing on the inner walls a, b, c and d of the inner race 51*a* and the lower viscosity liquid in the inner races 51*a*. Since the balls 52*a* and 52*b* move in the inner and outer races 51*a* and 51*b* at different speeds, they can more effectively eliminate the abnormal vibration of the spin basket 30.

The roughness of the respective races 51*a* and 51*b* is inversely related to the diameter of each of the balls 52*a* and 52*b* seated in the inner race 51*a* and outer race 51*b* during the normal operation of the spin basket 30, so the balls 52*a* and 52*b* do not vibrate abnormally, avoiding damage to the normal operation of the spin basket 30.

As described above, the drum washing machine balancing device of the present invention may dynamically counteract an imbalance, created by the uneven distribution of laundry in the washing machine's spin basket during rotation, in the initial stage of the creation to thereby preclude noise and vibration due to the abnormal rotation of the spin basket.

The balls of the inventive balancing device may dynamically counteract the vibration of the spin basket more promptly by making the balls move in the inner and outer races at different speeds. In addition, the smoothness of inner walls of the races is varied depending on the diameters of the balls held therein, thereby preventing the spin basket from vibrating abnormally because of the vibration of the balls.

What is claimed is:

1. A drum washing machine, comprising:

a housing;

a tub suspended in the housing;

a drum-type spin basket rotatably installed in the tub; and at least two radially spaced races provided on the spin basket concentric with the spin basket, each race containing liquid and a plurality of balls;

an internal ball-contacting surface of a radially inner one of the races being smoother than an internal ball-contacting surface of a radially outer one of the races;

the liquid in the inner race having less viscosity than the liquid in the outer race; and the balls in the outer race being of larger diameter than the balls in the inner race.

2. The washing machine according to claim 1 wherein a roughness of the internal surface of the inner race is in the range of 1.5 S to 6 S, roughness of the internal surface of the outer race being about 12 S; the viscosity of the liquid in the inner race being 100±20 cst; the viscosity of the liquid in the outer race being 160±20 cst; the diameter of the balls in the inner race being 12.7±0.5 mm; the diameter of the balls in the outer race being 15.875±0.5 mm.

3. The washing machine according to claim 1 wherein the spin basket includes front and rear axially spaced end panels, said inner and outer races disposed on said front end panel and on said rear end panel.

* * * * *